US009085842B2

(12) United States Patent
Ulger et al.

(10) Patent No.: US 9,085,842 B2
(45) Date of Patent: Jul. 21, 2015

(54) WASHING MACHINE

(75) Inventors: Zehra Ulger, Istanbul (TR); Bahar Akar, Istanbul (TR); Emine Birci, Istanbul (TR); Ayse Toprak, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 773 days.

(21) Appl. No.: 12/593,870

(22) PCT Filed: Mar. 12, 2008

(86) PCT No.: PCT/EP2008/052928

§ 371 (c)(1),
(2), (4) Date: Sep. 29, 2009

(87) PCT Pub. No.: WO2008/119631

PCT Pub. Date: Oct. 9, 2008

(65) Prior Publication Data

US 2010/0095715 A1 Apr. 22, 2010

(30) Foreign Application Priority Data

Mar. 29, 2007 (TR) ..... a 2007 02056

(51) Int. Cl.
*D06F 35/00* (2006.01)
*D06F 39/02* (2006.01)

(52) U.S. Cl.
CPC ..... *D06F 35/001* (2013.01); *D06F 39/022* (2013.01)

(58) Field of Classification Search
CPC ..... D06F 35/001; D06F 39/022
USPC ..... 68/17 R, 207
See application file for complete search history.

(56) References Cited

U.S. PATENT DOCUMENTS

| | | | | | |
|---|---|---|---|---|---|
| 3,130,570 | A | * | 4/1964 | Rentzepis | 68/13 R |
| 3,194,628 | A | * | 7/1965 | Cannon | 8/137 |
| 3,456,462 | A | * | 7/1969 | Schaverien | 68/4 |
| 3,478,374 | A | * | 11/1969 | Gartley et al. | 8/158 |
| 4,915,986 | A | * | 4/1990 | Elias et al. | 427/164 |
| 5,688,289 | A | * | 11/1997 | Nishioka et al. | 8/137 |
| 5,765,403 | A | * | 6/1998 | Lincoln et al. | 68/13 R |
| 6,085,556 | A | * | 7/2000 | Moon | 68/13 A |
| 6,422,047 | B1 | * | 7/2002 | Magilton | 68/12.06 |
| 6,460,211 | B1 | * | 10/2002 | Chapman | 8/158 |
| 6,507,965 | B2 | * | 1/2003 | Kown | 8/158 |
| 6,742,208 | B2 | * | 6/2004 | Broker | 8/158 |
| 7,213,349 | B1 | * | 5/2007 | Brunner | 34/86 |
| 7,290,414 | B2 | * | 11/2007 | Houser et al. | 68/23.3 |

(Continued)

FOREIGN PATENT DOCUMENTS

| | | | |
|---|---|---|---|
| DE | 202005013207 U1 | | 9/2006 |
| JP | 06-277385 | * | 10/1994 |

(Continued)

OTHER PUBLICATIONS

Machine translation of KR 10-2004-0079141 A, no date.*

*Primary Examiner* — Joseph L Perrin
(74) *Attorney, Agent, or Firm* — Venjuris, P.C.

(57) ABSTRACT

By means of the present invention, the microorganisms accumulated inside the detergent dispenser (5) are eliminated thus the washed laundry is hygienic and also the washing machine (1) is made ready to start the next washing program in a more hygienic manner. This is achieved through introducing ozone gas directly into the detergent dispenser (5).

5 Claims, 1 Drawing Sheet

(56) References Cited

U.S. PATENT DOCUMENTS

| | | | | |
|---|---|---|---|---|
| 7,409,841 | B2 * | 8/2008 | Oh et al. | 68/12.23 |
| 7,421,867 | B2 * | 9/2008 | Bongini | 68/17 R |
| 7,454,928 | B2 * | 11/2008 | Houser et al. | 68/23.1 |
| 7,610,779 | B2 * | 11/2009 | Yang et al. | 68/12.02 |
| 7,644,515 | B2 * | 1/2010 | Doh | 34/603 |
| 2005/0229645 | A1 * | 10/2005 | Kim et al. | 68/17 R |
| 2005/0251925 | A1 | 11/2005 | Daniels | |
| 2005/0274157 | A1 * | 12/2005 | Yang | 68/17 R |
| 2006/0021393 | A1 * | 2/2006 | Oda et al. | 68/231 |
| 2007/0044517 | A1 * | 3/2007 | Yang et al. | 68/17 R |
| 2008/0092601 | A1 * | 4/2008 | Konides et al. | 68/13 R |
| 2009/0007601 | A1 * | 1/2009 | Suzuki et al. | 68/13 R |
| 2009/0126420 | A1 * | 5/2009 | Tsunemine et al. | 68/5 C |

FOREIGN PATENT DOCUMENTS

| | | | |
|---|---|---|---|
| JP | 08-299655 | * | 11/1996 |
| JP | 2007-075242 | * | 3/2007 |
| KR | 2004079141 | * | 9/2004 |
| KR | 1020040079141 A | * | 9/2004 |
| WO | 2007143785 A | | 12/2007 |

* cited by examiner

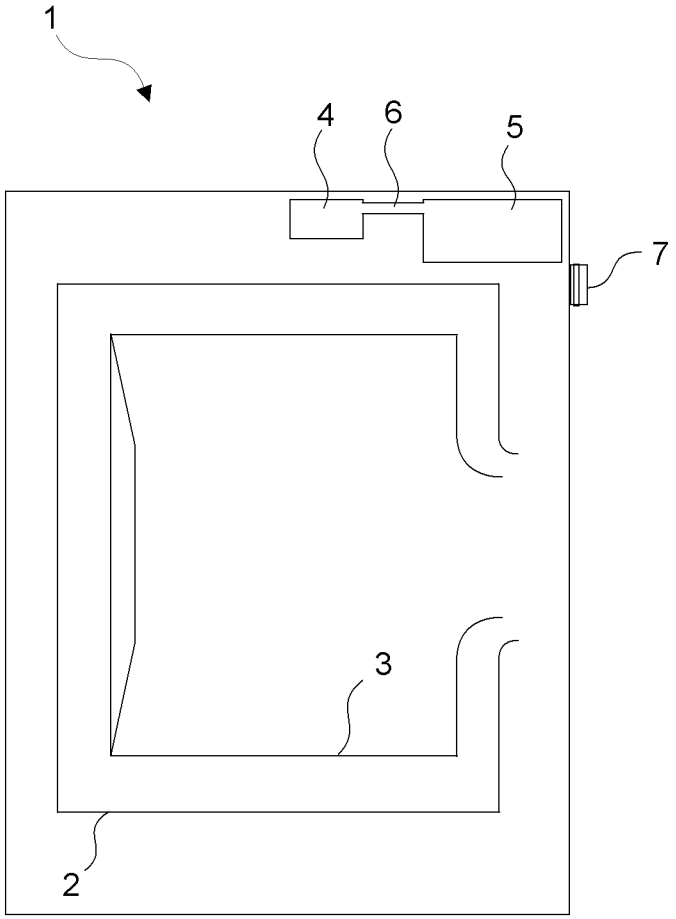
1
4
6
5
7
3
2

WASHING MACHINE

The present invention relates to a washing machine that comprises an ozone generator.

The high humidity rate of locations like the bathroom etc. where washing machines are placed can result in the growth of bacteria on the surfaces of the detergent dispenser. The microorganisms that accumulate on the detergent dispenser can be carried by water during the washing process and accumulate in water and on the laundry. Therefore, a totally hygienic washing process cannot be achieved at the end of the washing program implemented in the washing machines.

In state of the art embodiments, the detergent dispenser is detached and can be cleaned by the user or can be washed with water for cleansing the microorganisms accumulated thereon.

In the state of the art German Patent Application No DE10122514, a detergent dispenser is explained that has self-cleaning structured walls which come into contact with the cleaning agent. The self-cleaning structured surface is provided by a roughly structured surface which comes into contact with the cleaning agent.

The object of the present invention is to design a washing machine wherein the detergent dispenser is made hygienic.

The washing machine designed to fulfill the objective of the present invention, explicated in the first claim and the respective claims thereof, comprises an ozone generator that delivers ozone gas directly into the detergent dispenser.

Consequently, ozone gas is delivered into the detergent dispenser before the washing process or after the washing process, providing to eliminate the microorganisms remaining in the detergent dispenser.

By means of the present invention, particularly the softener partition wherein more microorganisms accumulate than other partitions is also cleansed of microorganisms.

In another embodiment of the present invention, after the washing process is completed, the ozone generator is energized automatically and sprays ozone gas into the detergent dispenser. Accordingly, particularly the softener partition wherein more microorganisms accumulate after the washing process will be eliminated and the washing machine will be ready for the next washing process. In this embodiment, ozone gas is sprayed into the detergent dispenser after each washing process for a time period determined by the producer—for example 3 minutes—. Consequently, the effectiveness of the ozone gas is increased.

In another embodiment of the present invention, the ozone generator is energized by the user for spraying ozone gas into the detergent dispenser before starting the washing process and before putting in detergent and softener in the detergent dispenser. Thus microorganisms that remain inside the detergent dispenser during or after the previous washing process are eliminated.

By means of the present invention, as well as increasing the hygienic feature of the water and the items to be washed, the hygienic feature of the washing machine is also increased and the microorganisms are prevented from commingling on the items to be washed or the wash water before or after the washing process.

The washing machine designed to fulfill the objective of the present invention is illustrated in the attached figures, where:

FIG. 1—is the schematic view of a washing machine.

The elements illustrated in the figures are numbered as follows:

1. Washing machine
2. Tub
3. Drum

4. Ozone generator
5. Detergent dispenser
6. Channel
7. Control knob The washing machine (1) of the present invention comprises a tub (2), a drum (3) disposed within the tub (2) and wherein the laundry to be washed is emplaced, a detergent dispenser (5) having one or more partitions wherein cleaning agents (detergent, softener etc.) with different features are put and an ozone generator (4) providing to deliver the ozone gas into the detergent dispenser (5) (FIG. 1).

A washing program is implemented in the washing machine (1) that is comprised of preferably a pre-wash cycle, a main wash cycle that is followed by the rinsing and spin-drying cycles. The microorganisms that accumulate inside the detergent dispenser (5) are eliminated by ejecting ozone gas into the detergent dispenser (5) by the ozone generator (4).

The washing machine (1) furthermore comprises a channel (6), one end of which is attached to the ozone generator (4) and the other end attached to the detergent dispenser (5) that delivers the ozone gas generated by the ozone generator (4) into the detergent dispenser (5).

In this embodiment of the present invention, when the ozone generator (4) is operated, the ozone gas generated is directly sprayed into the detergent dispenser (5) by means of the channel (6). Thus, all the partitions of the detergent dispenser (5) come into contact with the ozone gas and all the surfaces of the detergent dispenser (5) that interact with ozone gas are cleansed of microorganisms.

In an embodiment of the present invention, the washing machine (1) comprises a control knob (7) for the ozone generator (4) to be operated by the user. Accordingly, the user, when desired, can activate the ozone generator (4) to deliver ozone gas onto the detergent dispenser (5) and cleanse the detergent dispenser (5).

In another embodiment of the present invention, the ozone generator (4) is operated automatically for spraying ozone gas into the detergent dispenser (5) after the washing process is completed. Thus, the effectiveness of the ozone gas is increased by spraying ozone gas on the damp surfaces of the detergent dispenser (5). Moreover, the microorganisms that may accumulate on the detergent dispenser (5) after the washing process are exterminated. By this embodiment of the present invention, the washing machine (1) is made ready for the next washing process. In this embodiment, ozone gas is delivered to the detergent dispenser (5) during the washing process, after the last water intake process into the detergent dispenser (5).

In another embodiment of the present invention, the ozone generator (4) is operated by the user before the washing process starts and the accumulated microorganisms in the detergent dispenser (5) are eliminated before starting the washing process. In this embodiment of the present invention, ozone gas is delivered into the detergent dispenser (5) before the cleaning agents are put so that the effectiveness of the cleaning agents is not decreased.

In one of the alternative embodiments of the present invention, simultaneously with ozone gas, water is intaken into the detergent dispenser (5) and the ozone gas-water mixture is passed through the detergent dispenser (5) and discharged. Thus the possibility of ozone gas leaking outside of the washing machine (1) is minimized.

By means of the present invention, the microorganisms remaining inside the detergent dispenser (5) are eliminated thus the washed laundry is hygienic and also the washing machine (1) is ready to start the next washing program in a more hygienic manner.

The invention claimed is:

1. A washing machine (1) comprising a tub (2), a drum (3) disposed within the tub (2) and wherein the laundry to be washed is emplaced, and a detergent dispenser (5) having partitions with surfaces wherein cleaning agents with different features are put and an ozone generator (4) and a channel (6) having one end attached to the ozone generator (4) and the other end attached to detergent dispenser (5) and wherein the channel is configured to directly spray the ozone gas on all of the partitions of the detergent dispenser (5) such that all of the surfaces of the partitions interact with the ozone gas and are cleansed of microorganisms.

2. The washing machine (1) as in claim 1, characterized by the ozone generator (4) that is operated after the washing process is completed.

3. The washing machine (1) as in, claim 1, characterized by the ozone generator (4) that is operated by the user before the washing process starts.

4. The washing machine (1) as in, claim 1 characterized by the ozone generator (4) that enables ozone gas to be delivered simultaneously with water intake into the detergent dispenser (5).

5. The washing machine (1) as in, claim 1 characterized by a control knob (7) for the ozone generator (4) to be operated by the user.

* * * * *